US005752487A

United States Patent [19]

Harrell et al.

[11] Patent Number: 5,752,487

[45] Date of Patent: May 19, 1998

[54] INJECTOR COMBUSTION GAS SEAL

[75] Inventors: Bradley W. Harrell, Normal; Alan R. Stockner, Metamora, both of Ill.

[73] Assignee: Caterpillar Inc., Peoria, Ill.

[21] Appl. No.: 872,864

[22] Filed: Jun. 11, 1997

[51] Int. Cl.[6] ..... F02M 55/02

[52] U.S. Cl. ..... 123/470

[58] Field of Search ..... 123/468–9, 470, 123/472; 239/533.2, 585.1

[56] References Cited

U.S. PATENT DOCUMENTS

| | | | |
|---|---|---|---|
| 3,334,617 | 8/1967 | Palkowsky | 123/470 |
| 3,382,851 | 5/1968 | De Luca | 123/470 |
| 3,717,305 | 2/1973 | Hedges | 239/288.5 |
| 3,841,277 | 10/1974 | Schafer | 123/470 |
| 4,307,693 | 12/1981 | Glockler et al. | 123/470 |
| 4,589,596 | 5/1986 | Stumpp et al. | 123/470 |
| 4,647,012 | 3/1987 | Gartner | 123/470 |
| 5,086,980 | 2/1992 | Hickey | 239/585 |
| 5,328,100 | 7/1994 | Bergstrom et al. | 239/585.4 |
| 5,345,913 | 9/1994 | Belshaw et al. | 123/470 |
| 5,372,113 | 12/1994 | Smith | 123/470 |
| 5,487,368 | 1/1996 | Bruning | 123/470 |

*Primary Examiner*—Thomas N. Moulis
*Attorney, Agent, or Firm*—Michal B. McNeil

[57] ABSTRACT

A fuel injector combustion gas seal includes an engine head with an injector bore. A fuel injector having an outer surface and a nozzle outlet is positioned in the injector bore. An elastomeric ring shaped carbon dam made from a first material is mounted at a first location on the outer surface in contact with the engine head. An elastomeric O-ring made from a second material is mounted at a second location on the outer surface in contact with the head. The second location is further away from the nozzle outlet of the fuel injector than the first location. The first material is capable of withstanding temperatures up to about 400° F. for a substantial period of time without undergoing significant degradation.

20 Claims, 2 Drawing Sheets

INJECTOR COMBUSTION GAS SEAL

TECHNICAL FIELD

The present invention relates generally to strategies for sealing against combustion gas leakage around fuel injectors, and more particularly to an injector combustion gas seal that employs a carbon dam.

BACKGROUND ART

Engineers are often looking for ways to reduce or eliminate combustion gas leakage around fuel injectors mounted in an engine. Combustion gas leakage is particularly problematic in the case of diesel type engines since the injector bores in the head of the engine open directly to the combustion space. In the past, adequate sealing around the injectors has been accomplished through the use of a combination of malleable metallic (copper, brass, etc.) sleeves, elastomeric O-rings and substantially large clamping forces pushing the individual injector into its bore in the engine. Because of the necessary dimensional tolerancing of the injector's outer surface, injector bore in the engine and the malleable metallic sleeve, combustion gas leakage can still sometimes occur despite the relatively high clamping forces used to attach fuel injectors to a given engine. In other words, combustion gas leakage can occasionally occur around one or more fuel injectors of an engine despite the fact that all of the fuel injector clamps have been torqued down with the same relatively high magnitude. In addition, engine vibrations and/or thermal loads can sometimes cause one or more injector clamping bolts to slightly loosen over an extended period of time, resulting in combustion gas leakage.

Adequate sealing against combustion gas leakage can only partially rely upon conventional elastomeric O-ring sealing techniques because conventional O-ring materials can typically not withstand the relatively high temperatures and cyclic pressures encountered near the tip of a fuel injector. Conventional O-rings usually can only withstand temperatures up to about 300° F., and at the higher end of this scale the useful life of a given O-ring is relatively short.

The problem of protecting against combustion gas leakage around fuel injectors poses even a greater problem for engineers when one can no longer rely upon relatively high clamping forces. In an effort to reduce the transfer of noise from the operation of a fuel injection system to an engine, engineers have sought a way of isolating the fuel injection system from the engine. One method of accomplishing this isolation is to suspend the individual injectors in their injector bores rather than clamping the same down into the injector bores as in the past. When fuel injectors are merely suspended in an injector bore rather than being clamped down into the injector bore, the problem of protecting against combustion gas leakage becomes even more problematic.

The present invention is directed to overcoming one or more of the problems as set forth above.

DISCLOSURE OF THE INVENTION

A fuel injector combustion gas seal includes a ring shaped carbon dam made from a first material that is sufficiently elastomeric to be mounted at a first location on an outer surface of the fuel injector without breaking. An O-ring made from a second material is sufficiently elastomeric to be mounted at a second location on the outer surface of the fuel injector without breaking. The second location is further away from the nozzle outlet of the fuel injector than the first location. Finally, the first material is capable of withstanding temperatures up to about 400° F. for a substantial period of time without undergoing significant degradation.

In another embodiment of the present invention, an engine with a fuel injector combustion gas seal includes a head with an injector bore. A fuel injector having an outer surface and a nozzle outlet is positioned in the injector bore. An elastomeric ring shaped carbon dam made from a first material is mounted at a first location on the outer surface in contact with the engine head. An elastomeric O-ring made from a second material is mounted at a second location on the outer surface of the fuel injector in contact with the head. The second location is further away from the nozzle outlet of the fuel injector than the first location. Finally, the first material is capable of withstanding temperatures up to about 400° F. for a substantial period of time without undergoing significant degradation.

BEST MODE FOR CARRYING OUT THE INVENTION

Figure 1:
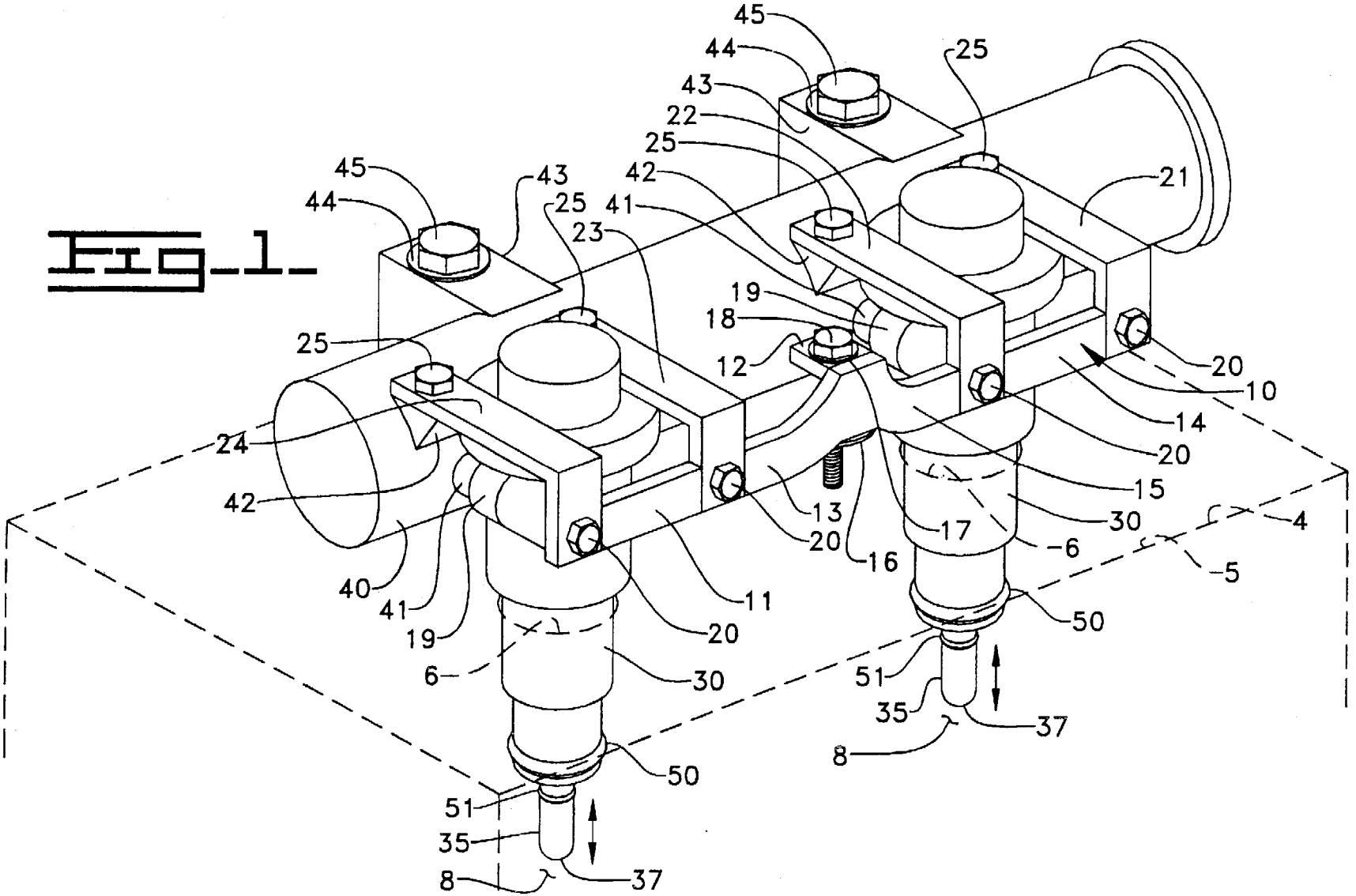
FIG. 1 is an isometric view of a portion of an engine with a fuel injector combustion gas seal according to one embodiment of the present invention.

Referring now to FIG. 1, a noise reducing fuel injection system includes a pair of hydraulically actuated fuel injectors 30 that are connected to an actuation fluid common rail 40 and to an engine 4 via a noise reducing bracket 10. Noise reducing bracket 10 includes a support 12 that is attached to the head 5 of engine 4 via a conventional fastener, such as bolt 18. However, bracket 10 is vibrationally isolated from the engine by a pair of washers 16 and 17, which are made from a suitable resilient material. Washers 16 and 17 could also be one or more bellville type washers. Washer 17 is positioned between support 12 and bolt 18, whereas washer 16 is positioned between support 12 and the engine head 5. In addition to support 12, noise reducing bracket 10 includes a first clamping portion 11 separated from support 12 by a first arm portion 13, and a second clamping portion 14 separated from support 12 by a second arm portion 15. Arms 13 and 15 are preferably positioned on opposite sides of support 12.

Clamping portions 11 and 14 are each clamped to a respective fuel injector 30 via a pair of bolts 20 that are received in threaded openings in supply pipe flange 48 of supply pipe 41 originating from actuation fluid rail 40. In this way, a portion of the fuel injector body is surrounded and held in a substantially rigid position with respect to noise reducing bracket 10. The clamp load is preferably applied through the centerline of the injector in order to avoid distortion of internal injector components and passageways. Injector 30 includes a flat surface against which supply pipe flange 48 abuts. A conventional "D"-ring prevents leakage when supply pipe 41 is mated to clamping portion 11 or 14. In order to further rigidify and couple the mass of fuel injectors 30 with actuation fluid rail 40, each clamping portion 11 and 14 includes over the top extensions 21–24. Extensions 21–24 are rigidly attached to fluid rail 40 at mounts 42 via conventional bolts 25. Thus, noise reducing bracket 10 serves as both the means by which the actuation fluid inlet of injectors 30 are connected to fluid rail 40 and also the means by which the mass of fluid rail 40 is coupled to that of the injectors.

Common fluid rail 40 is attached to engine 4 via mounts 43 and conventional fasteners, such as bolts 45. However, like support 12 of noise reducing bracket 10, fluid rail 40 is preferably isolated from the engine by positioning resilient washers 44 between bolt 45 and mounts 43. Washers 44 could also be bellville type washers. Additional resilient or bellville washers, which cannot be seen, are preferably positioned between mounts 43 and engine head 5.

By utilizing resilient washers when attaching mounting bracket 10 and common fluid rail 40 to engine 4, the combined mass of fuel injectors 30 and fluid rail 40 is isolated from the engine. The stiffness of the combined mass is isolated from the engine by the low stiffness of the mounting washers. Furthermore, the substantially rigid connection between clamping portions 11 and 14 with fluid rail 40 serves to increase the effective mass of each fuel injector 30. Those skilled in the art will appreciate that this mounting method is intended to reduce the transfer of noise from within the fuel injectors to the engine. This noise can be produced, for example, by various components within the injector hitting their seats or by rapid hydraulic pressure changes occurring during the operation of the fuel injection system.

Because mounting bracket 10 essentially allows fuel injectors 30 to be suspended within respective injector bores 6 within engine head 5, rather than being bolted directly to the head as in the prior art, less vibrational impulses produced within injectors 30 are transferred to the engine. The noise reduction of this mounting technique is further accomplished by giving arm portions 13 and 15 a combination of flexibility and stiffness that allows injectors 30 to move up and down a slight distance with respect to injector bore 6 when the engine is running. This slight distance would of course vary depending upon the size of the engine, the magnitude of the vibration to be considered, and other factors, but is preferably less than about 0.2 millimeters.

Figure 2:
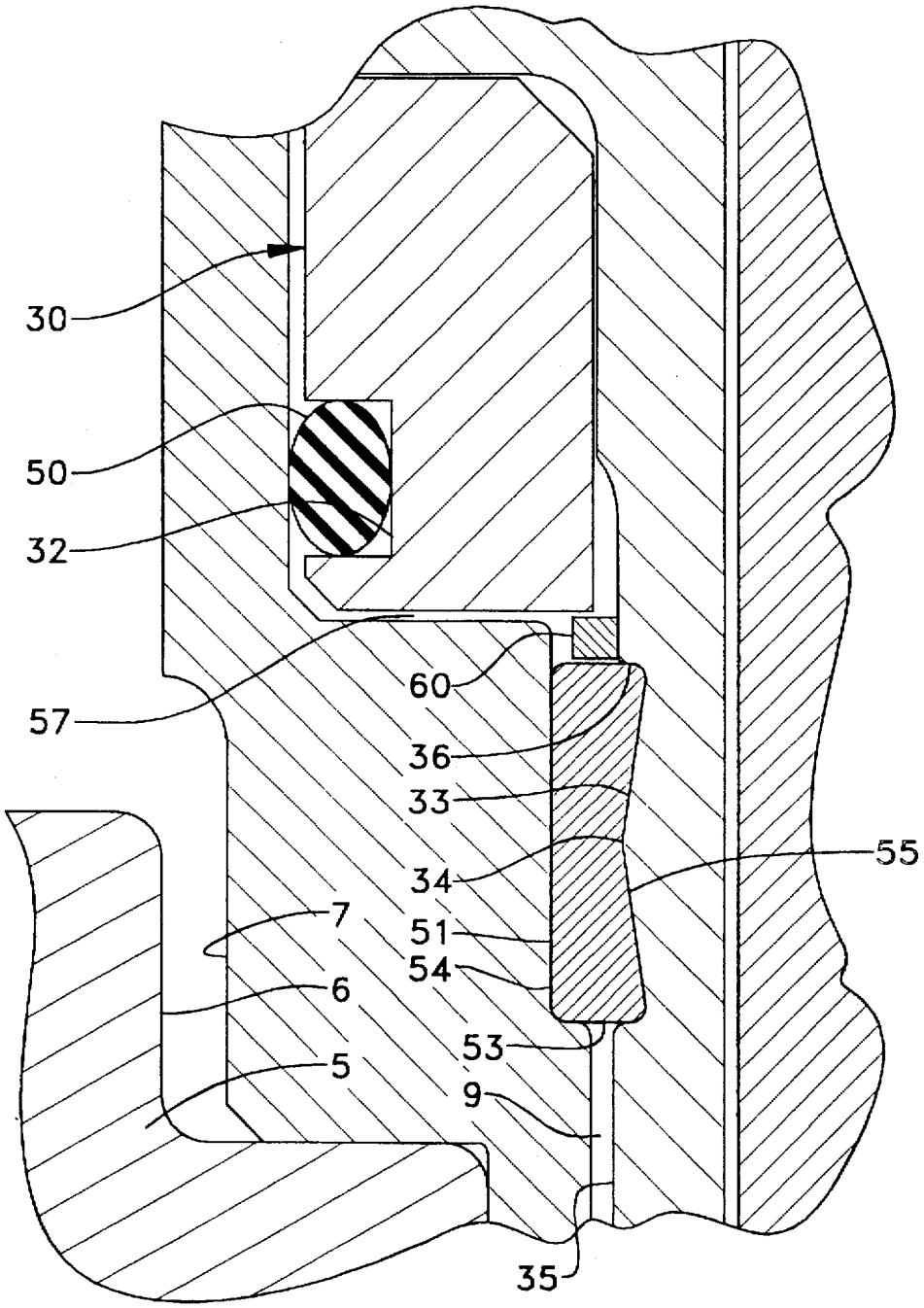
FIG. 2 is a partial sectioned side elevational view of an engine with a fuel injector combustion gas seal according to the preferred embodiment of the present invention.

Referring now in addition to FIG. 2, because injectors 30 are suspended within injector bores 6 made in engine head 5 via mounting bracket 10, it is important that the combustion chamber 8 of the engine be adequately sealed against the escape of combustion gases via annular passage 9, which corresponds to the area between the tip of injector 30 and a conventional sleeve 7 that is received within injector bore 6. In the present case, adequate sealing is accomplished by including two sealing rings 50 and 51 around the outer surface of injector 30. Lower sealing ring 51 is preferably a carbon dam that is made from a first material capable of withstanding temperatures up to about 400° F. for a substantial period of time without undergoing significant degradation. Experience has shown that conventional elastomeric O-rings are unable to withstand the relatively high temperatures and pressures occurring near the tip of a fuel injector, without degrading rather quickly. Carbon dam 51 is received in and held in place in an indentation 36 made in the side of tip 35 of injector 30. Further sealing is accomplished by including a conventional O-ring seal 50, which is preferably made from a suitable resilient material, and positioned in indentation 32 at a location above carbon dam 51, which is further away from the nozzle outlet 37 of fuel injector 30.

Because conventional O-ring materials are unsuited for the relatively high temperatures experienced around the tips of fuel injectors, carbon dam 51 is preferably made from a suitable substantially pure synthetic fluorocarbon containing resin such as a tetraflouroethylene polymer, which is more commonly known under the trade name TEFLON®. Such a material is sufficiently elastomeric to be mounted on the outer surface of a fuel injector without breaking, is capable of withstanding temperatures up to about 400° F. for a substantial period of time without undergoing significant degradation and has a low co-efficient of friction so as to not inhibit sliding of the injector. In the present case, a substantial period of time would be on the order of hours in operating engine 4, and substantial degradation would be an amount of degradation which would allow sufficient amounts of hot combustion gases to escape past carbon dam 51 that O-ring 50 would become damaged. O-ring 50 should preferably be positioned sufficiently far away from carbon dam 51 that it does not experience temperatures above about 300° F., which is about the maximum acceptable temperature range for conventional O-ring seals. This is accomplished by separating carbon dam 51 from O-ring 50 by a cooling passage 57 that has sufficient volume and length that any combustion gas leaking past carbon dam 51 and coming into contact with O-ring 50 is of a sufficiently low temperature that O-ring 50 remains substantially free of degradation over at least one billion combustion cycles of engine 4.

In order to further effectuate the effectiveness of carbon dam 51, it is preferably made to have a cross sectional shape with a majority of its perimeter in contact with the engine head or the outer surface of fuel injector 30. In this case, sleeve 7 is considered part of the engine head. This is accomplished by giving carbon dam 51 a cross sectional shape that includes a plurality of straight portions 54 and 55 that are separated by corner portions held in place with respective shaping of the engine head and/or indentation 36 in the outer surface of the fuel injector. In the preferred embodiment, carbon dam 51 preferably has a polygonal shape, which in this case is rectangular with the long axis of the rectangle being aligned with the centerline of the injector. In this case, indention 36 includes a protrusion 34 that aids in squeezing flat surface 54 against sleeve 7 of engine head 5. In order to inhibit detrimental deformation of carbon dam 51 during the relatively high pressures occurring during combustion, some means is provided for preventing the carbon dam from deforming. In this example, a metallic ring 60 is positioned just above carbon dam 51 and serves to prevent substantial deformation of the carbon dam. An alternative might be to include different shaping on the outer surface of the injector to prevent such deformation during combustion.

Industrial Applicability

Although the present invention has been illustrated for use with a hydraulically actuated fuel injector that is suspended within the injector bore of an engine, the principles of the present invention could also be applied to virtually any fuel injector, including cam driven fuel injectors. In addition, the present invention could also be employed in those cases where the fuel injector is clamped into the injector bore. In such a case, the combustion sealing technique taught above would decrease sensitivity of combustion gas sealing to the clamping load placed on the injector.

When in operation, the effectiveness of carbon dam 51 in preventing leakage of combustion gas is further effectuated by the build-up of carbon from combustion on the underside 53 of carbon dam 51. This build-up of carbon on the underside 53 of carbon dam 51 will normally take place in a matter of hours when running engine 4, and will itself both protect carbon dam 51 from degradation and further enhance the sealing characteristics of the present invention. In other words, the build-up of carbon on underside 53 along with the relatively large contact surface between carbon dam 51 and the engine head and the injector's outer surface will prevent hot combustion gases from contacting conventional O-ring seal 50.

It should be understood that the above description is intended for illustrative purposes only, and is not intended to limit the scope of the present invention in any way. Those skilled in the art will appreciate that various modifications can be made to the illustrated embodiment without departing from the spirit of the present invention. For instance, carbon dam 51 and O-ring 50 could be made from the same material, or additional sealing rings could be employed other than the two illustrated in the preferred embodiment. In addition, a plurality of carbon dams could be employed in order to insure adequate carbon build-up to enhance sealing in the event that some degradation of the carbon dam could be expected to occur over the useful life of a given fuel injector. In any event, the scope of the present invention can be determined in terms of the claims set forth below.

We claim:

1. A fuel injector combustion gas seal comprising:

a ring shaped carbon dam made from a first material and being sufficiently elastomeric to be mounted at a first location on an outer surface of a fuel injector without breaking;

an O-ring made from a second material and being sufficiently elastomeric to be mounted at a second location on said outer surface of said fuel injector without breaking;

said second location being further away from a nozzle outlet of said fuel injector than said first location; and said first material being capable of withstanding temperatures up to about 400° F. for a substantial period of time without undergoing significant degradation.

2. The fuel injector combustion gas seal of claim 1 wherein said first material is different from said second material.

3. The fuel injector combustion gas seal of claim 2 wherein said first material includes a synthetic fluorine-containing resin.

4. The fuel injector combustion gas seal of claim 3 wherein said first material is a substantially pure tetraflouroethylene polymer.

5. The fuel injector combustion gas seal of claim 4 wherein said carbon dam has a cross-sectional shape that includes at least one straight portion.

6. The fuel injector combustion gas seal of claim 5 wherein said cross-sectional shape includes a plurality of straight portions separated by corner portions.

7. The fuel injector combustion gas seal of claim 6 wherein at least two adjacent straight portions of said plurality of straight portions are at a right angle relative to each other.

8. The fuel injector combustion gas seal of claim 7 wherein said cross-sectional shape is generally polygonal.

9. The fuel injector combustion gas seal of claim 8 wherein said cross-sectional shape is generally rectangular.

10. An engine with a fuel injector combustion gas seal comprising:

a head with an injector bore;

a fuel injector having an outer surface and a nozzle outlet positioned in said injector bore;

an elastomeric ring shaped carbon dam made from a first material mounted at a first location on said outer surface in contact with said head;

an elastomeric O-ring made from a second material mounted at a second location on said outer surface in contact with said head;

said second location being further away from said nozzle outlet of said fuel injector than said first location; and said first material being capable of withstanding temperatures up to about 400° F. for a substantial period of time without undergoing significant degradation.

11. The engine with a fuel injector combustion gas seal of claim 10 wherein said engine is a diesel engine with a combustion chamber, and said injector bore opens to said combustion chamber; and said nozzle outlet being positioned in said combustion chamber.

12. The engine with a fuel injector combustion gas seal of claim 10 wherein said carbon dam, said O-ring, said head and said outer surface of said fuel injector define a cooling passage of sufficient volume and length that any combustion gas leaking past said carbon dam and coming into contact with said O-ring is of a sufficiently low temperature that said O-ring remains substantially free of degradation over at least one billion combustion cycles of said engine.

13. The engine with a fuel injector combustion gas seal of claim 12 wherein said sufficiently low temperature is less than about 300° F.

14. The engine with a fuel injector combustion gas seal of claim 10 wherein said first material includes a synthetic fluorine-containing resin.

15. The engine with a fuel injector combustion gas seal of claim 14 wherein said first material is a substantially pure tetraflouroethylene polymer.

16. The engine with a fuel injector combustion gas seal of claim 10 further comprising a metallic ring positioned between said carbon dam and said O-ring and being operable to prevent substantial deformation of said carbon dam when said carbon dam is exposed to relatively high pressure during combustion.

17. The engine with a fuel injector combustion gas seal of claim 10 wherein said carbon dam has a cross-sectional shape with a perimeter; and a majority of said perimeter is in contact with said head or said outer surface of said fuel injector.

18. The engine with a fuel injector combustion gas seal of claim 17 wherein said cross-sectional shape includes a plurality of straight portions separated by corner portions.

19. The engine with a fuel injector combustion gas seal of claim 18 wherein at least two adjacent straight portions of said plurality of straight portions are at a right angle relative to each other.

20. The engine with a fuel injector combustion gas seal of claim 10 further comprising a mounting bracket attached to said engine and said fuel injector such that said fuel injector is suspended in said injector bore by said mounting bracket and is capable of moving up and down in said injector bore when said engine is running.

* * * * *